US011030938B2

(12) United States Patent
Zeng et al.

(10) Patent No.: US 11,030,938 B2
(45) Date of Patent: Jun. 8, 2021

(54) DISPLAY PANEL AND DISPLAY DEVICE

(71) Applicant: WUHAN CHINA STAR OPTOELECTRONICS SEMICONDUCTOR DISPLAY TECHNOLOGY CO., LTD., Wuhan (CN)

(72) Inventors: Mian Zeng, Wuhan (CN); Liang Sun, Wuhan (CN); Shoucheng Wang, Wuhan (CN)

( * ) Notice: Subject to any disclaimer, the term of this patent is extended or adjusted under 35 U.S.C. 154(b) by 0 days.

(21) Appl. No.: 16/609,218

(22) PCT Filed: Aug. 30, 2019

(86) PCT No.: PCT/CN2019/103719
§ 371 (c)(1),
(2) Date: Oct. 29, 2019

(87) PCT Pub. No.: WO2020/134156
PCT Pub. Date: Jul. 2, 2020

(65) Prior Publication Data

US 2020/0211443 A1 Jul. 2, 2020

(30) Foreign Application Priority Data

Dec. 28, 2018 (CN) ..... 201811631785.7

(51) Int. Cl.
*G09G 3/20* (2006.01)

(52) U.S. Cl.
CPC ... *G09G 3/2074* (2013.01); *G09G 2320/0626* (2013.01)

(58) Field of Classification Search
CPC ..... G09G 3/2074; G09G 3/3208; G09G 2300/0426; G09G 2320/0626
See application file for complete search history.

(56) References Cited

U.S. PATENT DOCUMENTS

| | | | | |
|---|---|---|---|---|
| 9,312,312 | B1 * | 4/2016 | Tsai | H01L 27/3216 |
| 2019/0213379 | A1 * | 7/2019 | Zhao | H01L 27/326 |
| 2019/0326366 | A1 * | 10/2019 | Fan | H01L 27/3218 |
| 2019/0341435 | A1 * | 11/2019 | Chang | H01L 27/3234 |
| 2019/0393280 | A1 * | 12/2019 | Gao | G02F 1/1333 |
| 2020/0111401 | A1 * | 4/2020 | Zhao | G09G 3/2003 |
| 2020/0211480 | A1 | 7/2020 | Xiang et al. | |
| 2020/0234634 | A1 * | 7/2020 | Li | G09G 3/3233 |

(Continued)

FOREIGN PATENT DOCUMENTS

| | | | |
|---|---|---|---|
| CN | 104134683 | A | 11/2014 |
| CN | 107425040 | A | 12/2017 |

(Continued)

*Primary Examiner* — Ariel A Balaoing

(57) ABSTRACT

A display panel and a display device are provided. The display panel includes a first driving circuit and a plurality of first pixel units. The first pixel units include an image display region and a light transmissive region, and the image display region is driven by the first driving circuit to provide a corresponding brightness. An opening is formed at an edge of the image display region, the light transmissive region is formed within the opening, and an incident light emitted from an outer side of the display panel passes through the light transmissive region. The image quality of the under-screen camera is improved in term of the pixel density.

13 Claims, 11 Drawing Sheets

(56) References Cited

U.S. PATENT DOCUMENTS

| | | | | |
|---|---|---|---|---|
| 2020/0249512 | A1* | 8/2020 | Gu | G02F 1/133606 |
| 2020/0321410 | A1* | 10/2020 | Wang | G09F 9/33 |
| 2020/0373514 | A1* | 11/2020 | Bai | H01L 51/5218 |
| 2021/0065625 | A1* | 3/2021 | Wang | G09G 3/3266 |

FOREIGN PATENT DOCUMENTS

| | | | |
|---|---|---|---|
| CN | 108717244 | A | 10/2018 |
| CN | 108829183 | A | 11/2018 |
| CN | 16609218 | A | 10/2019 |
| KR | 1020150080303 | A | 7/2015 |

* cited by examiner

DISPLAY PANEL AND DISPLAY DEVICE

BACKGROUND OF INVENTION

Field of Invention

The present invention relates to the field of display technology, and more particularly, to a display panel and a display device.

Description of Prior Art

With continuous development of the mobile phone industry, mobile phone display panels has also continuously developed, and functions on display panels have also increased. Current mobile phone display panels have been widely provided with camera module. Since camera device needs to be spaced from display panel, an area available for disposing display panel is reduced, which is contrary to the current trend of increasing ratio of mobile phone display panels. Camera module is an essential component of current mobile phones. Therefore, how to integrate camera with display panel to maximize screen ratio is an urgent problem that needs to be solved.

Front camera of display panels is disposed on the outside of display panels. Therefore, display panels need to be sized to accommodate the front camera and a part of the whole device cannot normally be operated, and finally most mobile phones are only be shaped and cut to reduce screen ratio, which is not good to achieve full screen display devices.

SUMMARY OF INVENTION

It is an object of the present invention to provide a display panel and a display device that improve the quality of images on the screen and increase the screen ratio of the display panel to the display device.

In one embodiment, a display panel includes a first driving circuit and a plurality of first pixel units. The first pixel units include an image display region and a light transmissive region. The image display region is driven by the first driving circuit to provide a corresponding brightness. The light transmissive region is formed on the outside the image display region corresponding to the first pixel units, and thus an incident light emitted from an outer side of the display panel passes through the light transmissive region.

In another embodiment, a display device includes above-mentioned display panel, and the display device further includes a photosensitive element disposed inside the display panel, and the photosensitive element collects incident light emitted from outside the display panel through a plurality of the light transmissive regions of the display panel.

The first pixel unit of the display panel is divided into an image display region and a light transmissive region. The light transmissive region is formed outside the image display region, and thus an incident light emitted from an outer side of the display panel passes through the light transmissive region. Therefore, the photosensitive element is disposed on the back side of the display panel, that is the photosensitive element is disposed on a side of the display panel away from a light emitting surface of the display panel, so that the photosensitive element collects incident light emitted from outside the display panel through a plurality of the light transmissive regions formed by the first pixel unit of the display panel and performs image acquisition. Such a design enables the photosensitive element such as a camera to be integrated with the display screen, and does not need to reserve a space for the camera on the display panel, so that the screen ratio is maximized and the user experience is improved. In addition, the image display region of the display panel occupies most of the area of the display panel, and an opening is formed at edge of the image display region, and the light transmissive region is formed within the opening, and the light transmissive region of each image display region is not surrounded by the corresponding image display region. The space of image display region is fully utilized, thereby improving area of the light transmissive region, the light transmittance, and the image quality. The image display region also has a normal display function, so the reduction in pixel density (Pixels Per Inch, PPI) is limited. The present invention can improve the light transmittance of the light transmissive region while considering the pixel density.

BRIEF DESCRIPTION OF DRAWINGS

In order to more clearly illustrate the technical solutions in the embodiments of the present invention, the drawings used in the description of the embodiments will be briefly described below. It is obvious that the drawings in the following description are only some embodiments of the present invention. Other drawings can also be obtained by persons skilled in the art based on these drawings, without making any creative effort.

Figure 1:
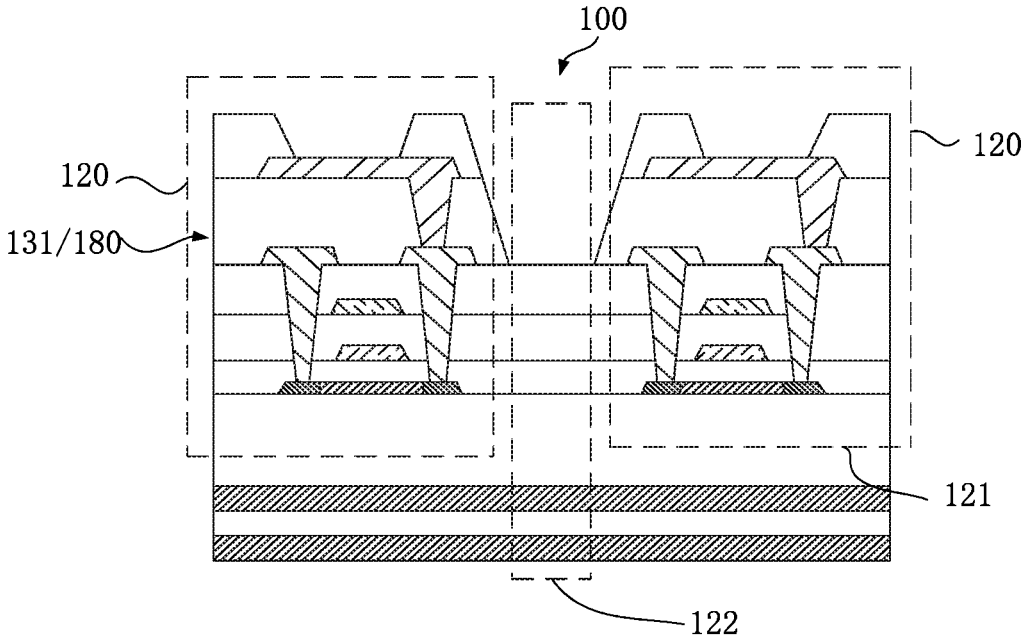
FIG. 1 is a schematic view of an unpublished display panel according to one embodiment of the present invention.

ELEMENT REFERENCES display panel 100; first substrate 111; second substrate 112; first pixel unit 120; image display region 121; light transmissive region 122; light transmissive combination region 123; opening 124; angular position 125; side position 126; first driving circuit 131; second driving circuit 132; display device 200; photosensitive element 140; second pixel unit 150; primary display region 160; auxiliary display region 170; active switch 180; and repeat unit 190.

DETAILED DESCRIPTION OF PREFERRED EMBODIMENTS

It is understood that the terminology, the specific structural details, and the details of the present invention are used for the purpose of describing the specific embodiments and are representative, but the present invention can be embodied in many alternative forms and should not be construed as merely limited by the embodiments set forth herein.

In the description of the present invention, the terms "first" and "second" are used for descriptive purposes only, and are not to be understood as indicating relative importance or implicitly indicating the number of technical features. Thus, unless otherwise indicated, a feature defining "first" or "second" may include one or more of the features either explicitly or implicitly, and "multiple" means two or more. The term "include" and its conjugations are intended to be inclusive, and may include or add one or more other features, integers, steps, operations, units, components, and/or combinations thereof.

In addition, the terms "center," "transverse," "upper," "lower," "left," "right," "vertical," "horizontal," "top," "bottom," "inside," and "outside" are described based on the orientation or relative positional relationship shown in the drawings, and they are used for the convenience of describing the simplified description of the present invention rather than indicating that the device or component referred to have a particular orientation, or constructed and operated in a particular orientation. Therefore, it should not be construed as limiting the present invention.

In addition, the terms "mounted", "attached", and "connected" are used in a broad sense, and may be, for example, a fixed connection, a detachable connection, or an integral connection. It may be a mechanical connection, unless otherwise explicitly stated and defined. It can also be an electrical connection. It can be directly connected, or it can be connected indirectly through an intermediate medium, or it can be connected internally. For persons skilled in the art, the specific meanings of the above terms in the present invention can be understood on a case-by-case basis.

The present invention is further described with accompanying drawings and embodiments.

The embodiments of the present invention are described by taking an organic light emitting diode display panel (OLED display panel) as an example, but the present invention is equally applicable to other display panels including liquid crystal display panels.

FIG. 1 shows an unpublished exemplary display panel 100, including a plurality of first pixel units 120, a light transmissive region 122 disposed between two adjacent image display regions 121 of the first pixel unit 120, and the image display region 121 is driven to display by an active switch 130 of the first driving circuit 131. Unless otherwise specified, the active switch 130 is described in the following embodiments by taking a thin film transistor as an example.

Figure 2:
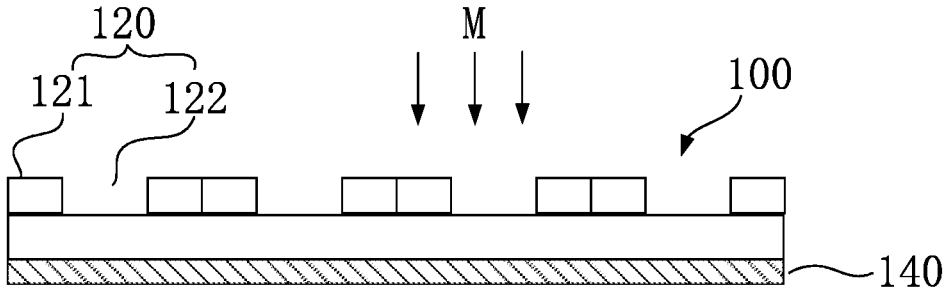
FIG. 2 is a schematic cross-sectional view of a display panel according to one embodiment of the present invention.
Figure 3:
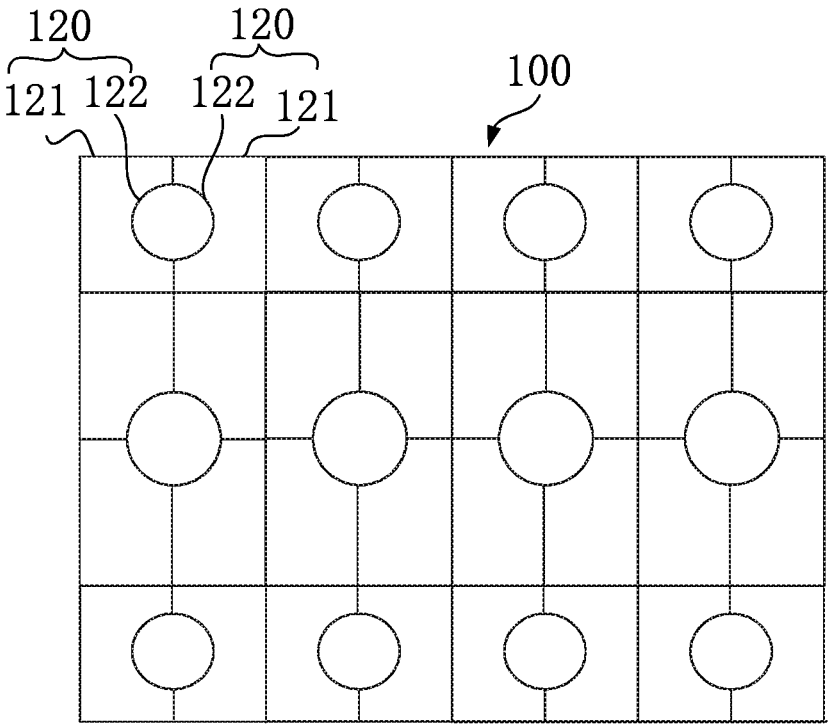
FIG. 3 is a top view of a display panel according to one embodiment of the present invention.
Figure 4:
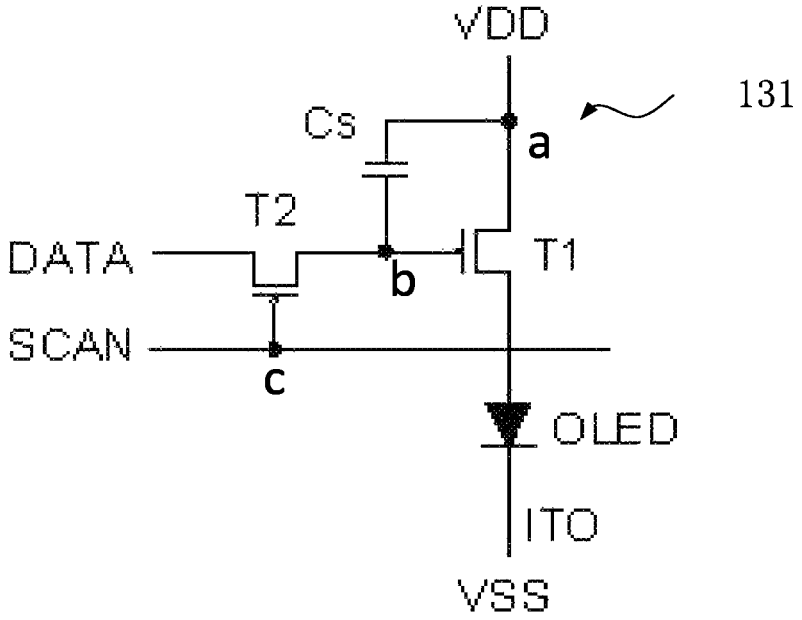
FIG. 4 is a schematic view of a first driving circuit with a 2T1C architecture according to one embodiment of the present invention.

Referring to FIG. 2 to FIG. 4, a display panel 100 includes a plurality of first pixel units 120 and a first driving circuit 131 driving the plurality of the first pixel units to provide a corresponding brightness. A light emitting surface of the display panel is considered as reference plane, and the first pixel units 120 include an image display region 121 and a light transmissive region 122. The image display region 121 is driven by the first driving circuit 131 to provide a corresponding brightness and display image. An opening 124 is formed at an edge of the image display region 121, the light transmissive region 122 is formed within the opening 124, and an incident light emitted from an outer side M of the display panel passes through the light transmissive region. The light transmissive region 122 is not surrounded by the image display region 121 of the same first pixel units 120, and a notch structure is formed at an edge of the corresponding image display region 121.

A light emitting surface of the display panel 100 is considered as reference plane, and the first pixel units 120 of the display panel 100 are divided into the image display region 121 and the light transmissive region 122. The light transmissive region 122 is formed outside the image display region 121, so that an incident light emitted from an outer side of the display panel 100 can pass through. It allows a photosensitive element to be disposed behind the display panel 100, that is, the photosensitive element is disposed on one side of the display panel 100, away from a light emitting surface of the display panel 100, so that the photosensitive element collects incident light emitted from outside the display panel 100 for image collection through a plurality of the light transmissive regions 122 formed on the first pixel units 120 of the display panel 100. Such a design enables the photosensitive element, such as a camera, to be integrated with the display screen, without the need to reserve space for the camera on the display panel 100, so that screen ratio is maximized and user experience is improved In addition, the image display region 121 of the display panel 100 occupies most of area of the display panel 100, and an opening is formed at an edge of the image display region 121, and the light transmissive region 122 is formed within the opening. In comparison to the exemplary embodiment of FIG. 1, the light transmissive region 122 of each image display region 121 is not surrounded by the corresponding image display region 121 through forming the light transmissive region in the image display region 121. Space of image display region 121 is fully utilized, thereby improving area of the light transmissive region 122, the light transmittance, and the image quality. The image display region 121 also assumes normal display function, so reduction in pixel density (pixels per inch, PPI) is limited. The present invention can improve light transmittance of the light transmissive region while taking pixel density into consideration. Moreover, since each of the first pixel units 120 of the light transmissive region 122 are opened, the light transmissive regions 122 of the adjacent first pixel units 120 have a possibility of connecting to each other, so that the light transmissive regions 122 become larger after combining with each other. Such a design enables a photosensitive element, such as a camera, to have larger lighting window, and the transmitted light is more concentrated to facilitate better imaging.

FIG. 4 is a schematic view of a first driving circuit 131 with a 2T1C architecture according to one embodiment of the present invention. The 2T1C means that each of the first pixel units 120 is driven by two thin film transistors and one capacitor. Specifically, a first driving circuit includes an organic light emitting diode (OLED), a first thin film transistor T1, a second thin film transistor T2, and a capacitor Cs. A source of the first thin film transistor T1 and a first terminal of the capacitor Cs are electrically connected to point a, and power supply positive voltage (VDD), which is typically generated and provided by a power generator of an organic light emitting diode display and not shown in the drawings. A gate of the first thin film transistor T1, a drain of the second thin film transistor T2, and a second terminal of the capacitor Cs are electrically connected to point b. A source of the second thin film transistor T2 is electrically connected to a data voltage (DATA), and the gate is electrically connected to point c and a scan signal (SCAN). A drain of the first thin film transistor T1 is connected to an anode of the organic light emitting diode (OLED), and a cathode of the organic light emitting diode (OLED) is electrically connected to a power source negative voltage (VSS), which is typically generated and provided by a power generator of the organic light emitting diode display and not shown in the drawings.

Figure 5:
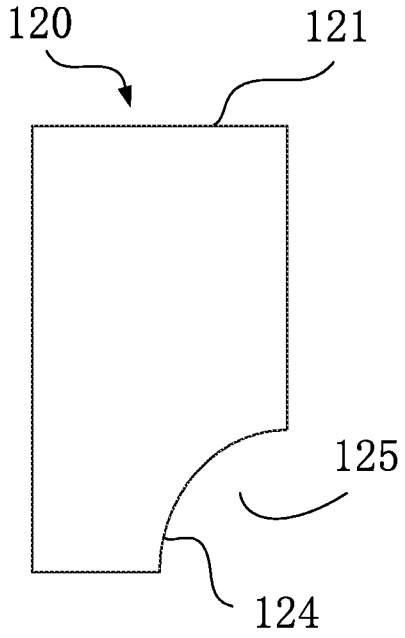
FIGS. 5-12 are various matching schematic views of a light transmissive region and an image display region according to one embodiment of the present invention.
Figure 6:
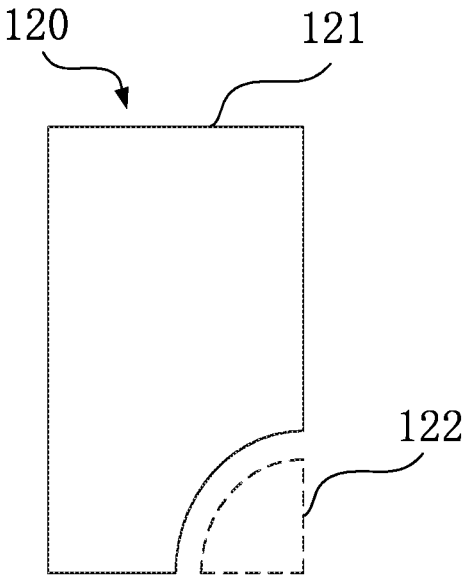
Figure 7:
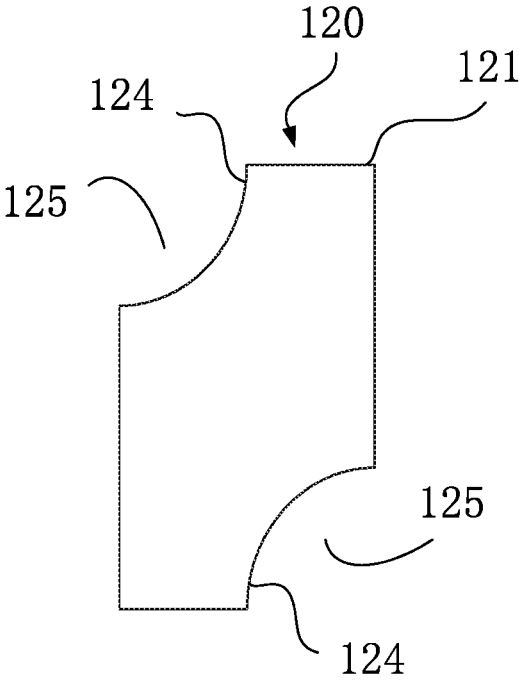
Figure 8:
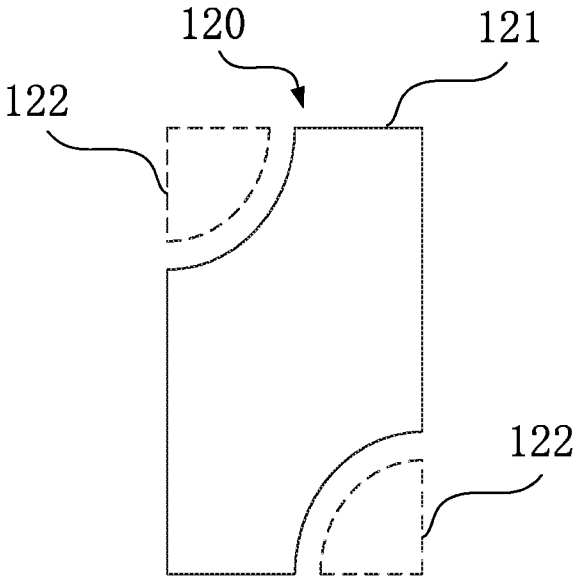
Figure 9:
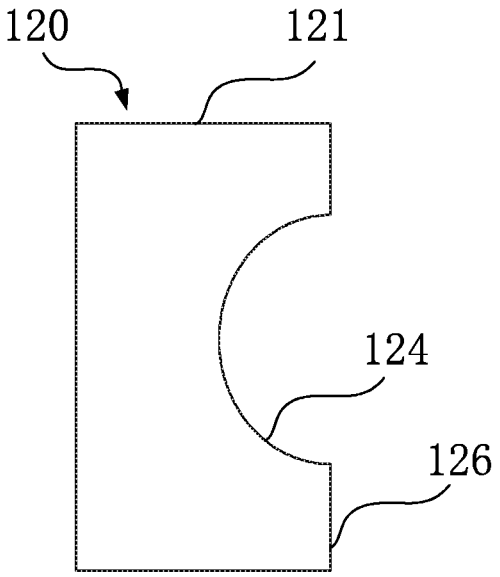
Figure 10:
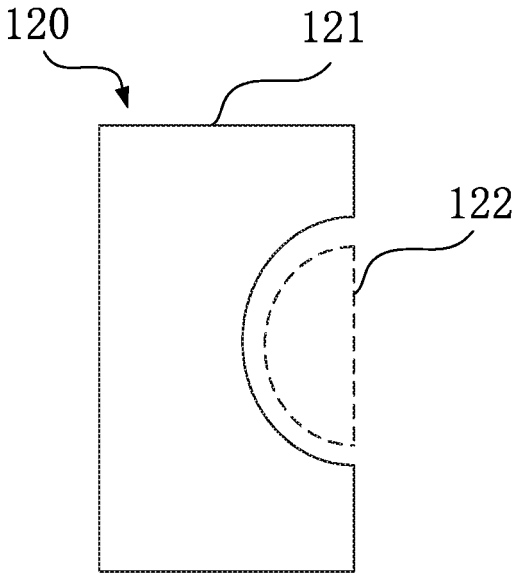
Figure 11:
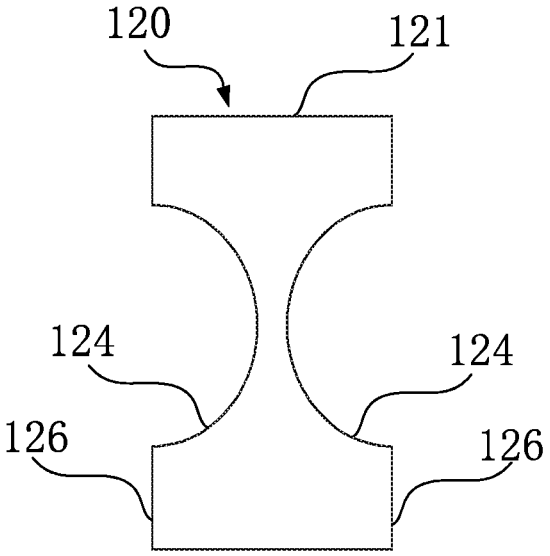
Figure 12:
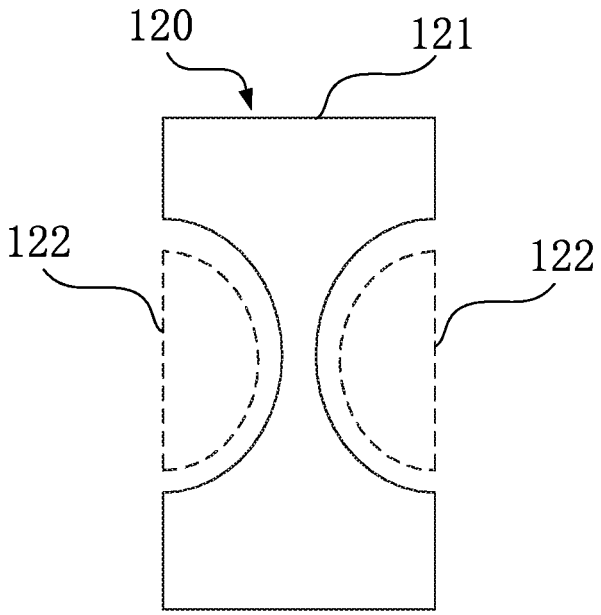

Referring to FIG. 5 to FIG. 12, the edge of the image display region 121 includes an angular position 125 and a side position 126. A notch 124 corresponding to the light transmissive region 122 may be disposed at the angular position 125 or the side position 126. As shown in FIG. 5 and FIG. 6, if the notch 124 corresponding to the light transmissive region 122 is disposed at the angular position 125, it may be disposed at a single angular position 125 of the image display region 121. As shown in FIG. 7 and FIG. 8, there may also be two notches 124, respectively disposed at two diagonal angular positions 125. As shown in FIG. 9 and FIG. 10, if the notch 124 corresponding to the light transmissive region 122 is disposed at the side position 126, it may be disposed only at the side position 126 corresponding to a long side of the image display region 121. As shown in FIG. 11 and FIG. 12, there may also be two notches 124, respectively disposed at side positions 126 corresponding to two long sides of the image display region 121.

Figure 13:
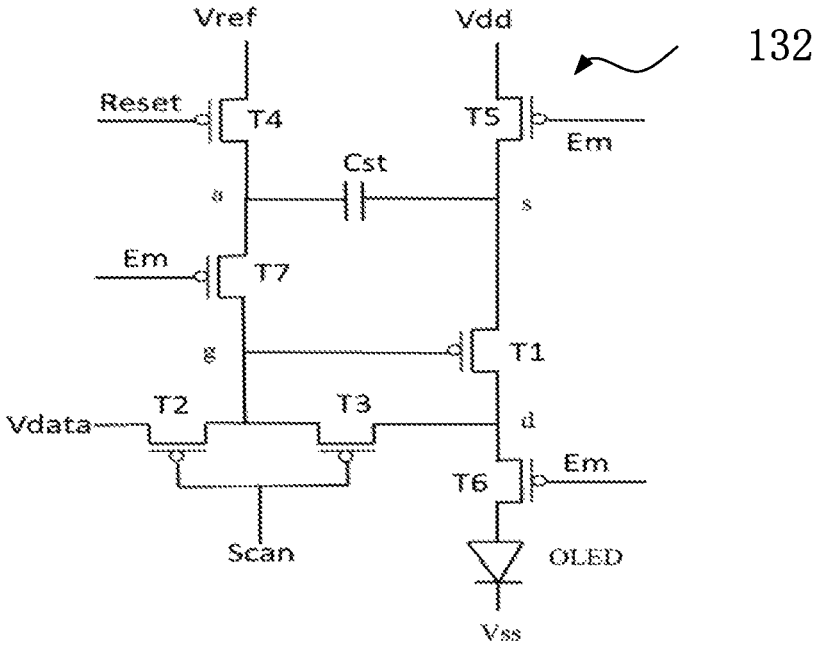
FIG. 13 is a schematic view of a second driving circuit with a 7T1C architecture according to one embodiment of the present invention.
Figure 14:
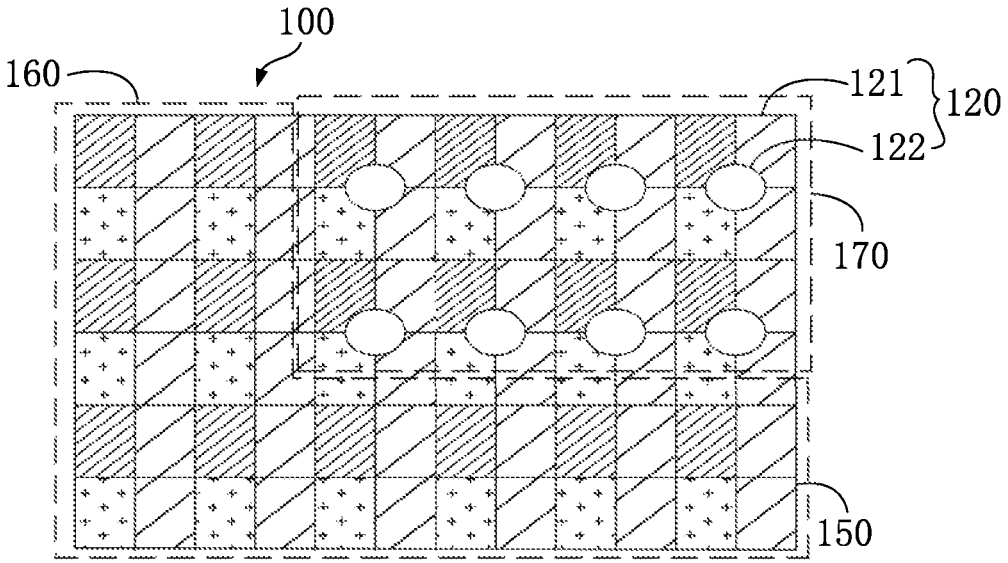
FIG. 14 is a plan view of a primary display region and an auxiliary display region according to one embodiment of the present invention.

Referring to FIG. 2, FIG. 13, and FIG. 14, the display panel 100 further includes a second pixel unit 150 and a second driving circuit 132, and the second driving circuit 132 drives a plurality of the second pixel units 150 to provide a corresponding brightness, and the light transmissive region 122 is only formed within the first pixel units 120. The second pixel units 150 are not provided with the light transmissive region 122.

Generally, area of the photosensitive element is limited, and it is impossible to completely cover all of the display panel 100. Therefore, the first pixel units 120 corresponding to the photosensitive element are merely provided with the light transmissive region 122, and structure of the second pixel units 150 without the photosensitive element remains unchanged, and the corresponding image display region 121 is intact, which does not affect the aperture ratio and reduces the impact on pixel density (PPI, pixels per inch) of the display panel 100.

Of course, the display panel 100 may also merely include the first pixel units 120 without the second pixel units 150. That is, all pixel units of the display panel 100 are provided with the light transmissive region 122.

The photosensitive element may also be disposed inside the display panel 100 and formed synchronously in manufacturing process of the display panel 100. The photosensitive element may be individually disposed in the display panel 100. Correspondingly, the first pixel units 120 are also individually disposed to form a plurality of auxiliary display regions 170 to increase lighting area and improve imaging quality. Since the first pixel units 120 are individually disposed, the photosensitive element has a plurality of lighting positions, and different positions of the same subject are used for lighting, which is similar to the technical solution of multi-camera imaging, and imaging quality can be improved by post-processing of software.

The first pixel units 120 may be relatively concentrated in a same region, that is, the auxiliary display region 170. Under the premise of taking into account the effect of screen display, incident light passing through the outside of the display panel 100 is collected for the photosensitive element to be collected. The second pixel units 150 are also relatively concentrated in the same region, and are mainly used for screen display of the display panel 100. The display panel 100 includes a primary display region 160 and the auxiliary display region 170. The primary display region 160 is provided with the second pixel units 150, and the auxiliary display region 170 is provided with the first pixel units 120. Correspondingly, the photosensitive element of the display device 200 is correspondingly disposed in the auxiliary display region 170.

The photosensitive element can be used as an independent component. The photosensitive element and the display panel 100 are integrated to achieve the function of under-screen camera. Therefore, the first pixel units 120 are concentrated in one region to form the auxiliary display region 170, and incident light is collected by the auxiliary display region 170 to form image in the photosensitive element.

Of course, the auxiliary display region 170 may also include the first pixel units 120 and the second pixel units 150 at the same time, and the second pixel units 150 are uniformly distributed in the first pixel units 120.

The number of active switches of the first driving circuit 131 driving the first pixel units 120 is less than the number of active switches of the second driving circuit 132 driving the second pixel units 150.

Since the image display region 121 of the OLED display panel 100 adopts the organic light emitting diode, brightness of light is attenuated over time. Therefore, the OLED display panel 100 generally needs to be driven by a plurality of thin film transistors to perform brightness compensation on the organic light emitting diode. In order to form a light transmissive region in the auxiliary display region 170, the thin film transistor of the auxiliary display region 170 may be reduced, and space of the light transmissive region is increased by simplifying circuit structure.

FIG. 13 is a schematic view of a second driving circuit 132 with a 7T1C architecture according to one embodiment of the present invention. The 2T1C means that each of second pixel units 150 is driven by seven thin film transistors and one capacitor. Specifically, the second driving circuit 131 includes an organic light emitting diode (OLED), a first thin film transistor T1, a second thin film transistor T2, a third thin film transistor T3, a fourth thin film transistor T4, a fifth thin film transistor T5, a sixth thin film transistor T6, a seventh thin film transistor T7, and a capacitor Cst. A gate electrode of the first thin film transistor T1 is electrically connected to a first node g, a source of the first thin film transistor T1 is electrically connected to a second node s, and a drain of the first thin film transistor T1 is connected to a third node d. A gate electrode of the second thin film transistor T2 is configured to receive a scan signal (Scan), a source of the second thin film transistor T2 is configured to receive a data voltage (Vdata), and a drain of the second thin film transistor T2 is connected to the first node g. A gate electrode of the third thin film transistor T3 is configured to receive the scan signal (Scan), a source of the third thin film transistor T3 is electrically connected to the first node g, and a drain of the third thin film transistor T3 is electrically connected to the third node d. A gate electrode of the fourth thin film transistor T4 is configured to receive a reset signal (Reset), a source of the fourth thin film transistor T4 is configured to receive a reference voltage (Vref), and a drain of the fourth thin film transistor T4 is electrically connected to the fourth node a. A gate electrode of the fifth thin film transistor T5 is configured to receive the enable signal (Em), and a source of the fifth thin film transistor T5 is configured to receive a power supply positive voltage (Vdd), which is usually generated and provided by a power generator (not shown) of an organic light emitting diode display device, and a drain of the fifth thin film transistor T5 is connected to the second node s.

A gate electrode of the sixth thin film transistor T6 is configured to receive the enable signal (Em), a source of the sixth thin film transistor T6 is connected to the third node d, and a drain of the sixth thin film transistor T6 is connected to an anode of the organic light emitting diode (OLED). A gate electrode of the seventh thin film transistor T7 is configured to receive the enable signal (Em), a source of the seventh thin film transistor T7 is connected to the fourth node a, and a drain of the seventh thin film transistor T7 is connected to the first node g. A first terminal of the capacitor Cst is connected to the fourth node a, and a second terminal of the seventh thin film transistor T7 is electrically connected to the second node s. A cathode of the organic light emitting diode (OLED) is configured to receive a power source negative voltage (Vss), which is typically generated and provided by the power generator (not shown) of the organic light emitting diode display device.

Of course, each first terminal of the first thin film transistor T1 to the seventh thin film transistor T7 may also be a drain, and second terminal of the first thin film transistor T1 to seventh thin film transistor T7 may be a source.

The first driving circuit and the second driving circuit may also adopt other circuit architectures such as 6T1C, 5T2C, etc., as long as the number of corresponding active switches of the first driving circuit is less than the number of active switches of the second driving circuit.

Figure 15:
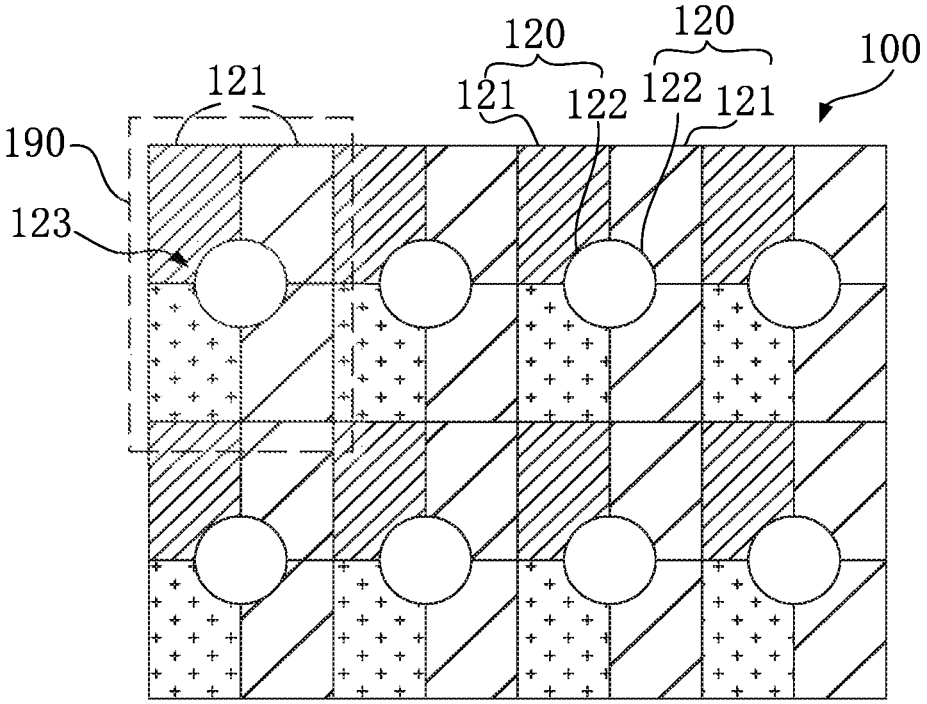
FIG. 15 is a schematic view of a light transmissive combination region according to one embodiment of the present invention.
Figure 16:
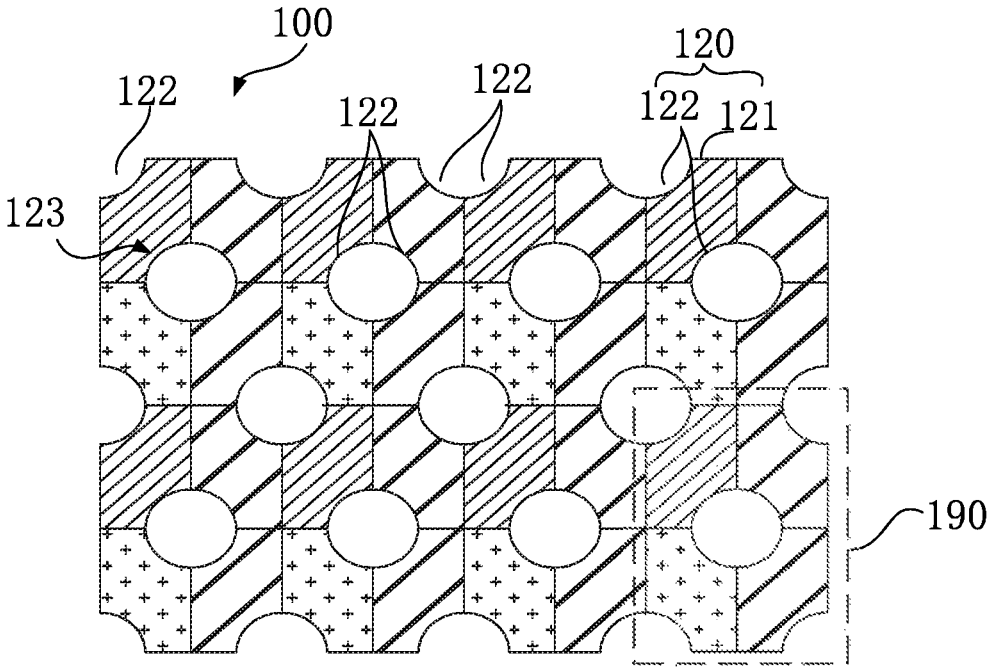
FIG. 16 is a schematic view of a light transmissive combination region according to another embodiment of the present invention.
Figure 17:
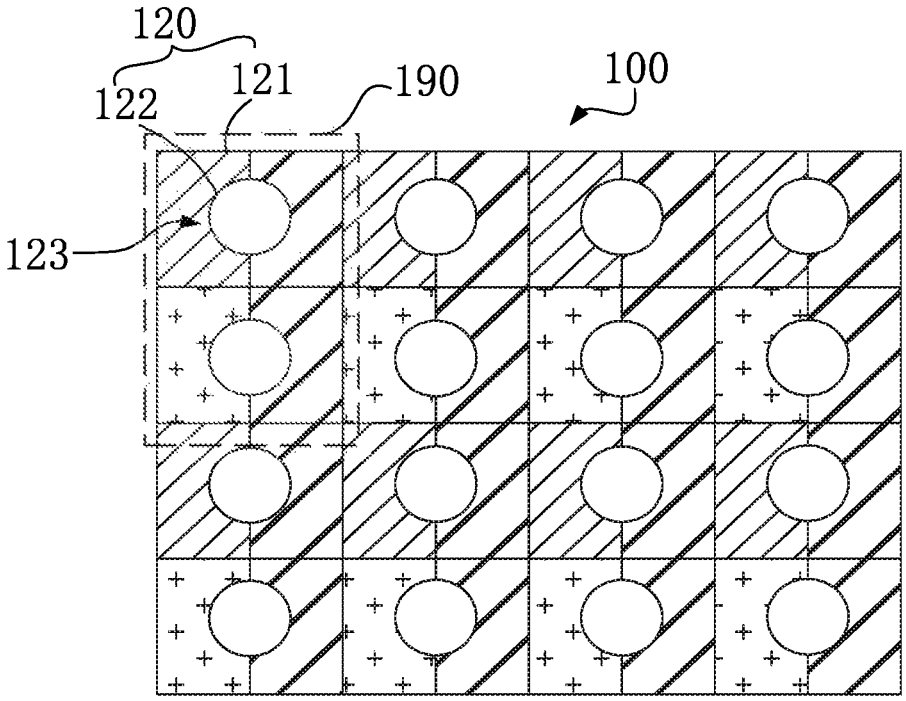
FIG. 17 is a schematic view of a light transmissive combination region according to yet another embodiment of the present invention.

Referring to FIG. 15 to FIG. 17, at least two of light transmissive regions 122 of the first pixel units 120 in the display panel 100 are adjacent to each other, and two adjacent light transmissive regions 122 are connected to form a light transmissive combination region 123. Correspondingly, the periphery of the light transmissive combination region 123 is surrounded by at least two of image display regions 121 of the first pixel units 120. The shape of the light transmissive combination region 123 may be a circle, a rectangle, a polygon, and other irregular shapes. According to different first driving circuits, different shapes of the first driving circuits can be chosen to ensure maximum light transmissive area.

Since the image display region 121 also has a display function, and light can pass through the image display region 121 during normal operation, which causes interference to the adjacent light transmissive region 122. The external ambient light and the interference light emitted by the image display region 121 enter the light transmissive region 122. An area of the light transmissive region 122 is too small, so the ambient light has a relatively small amount, and the influence of the interference on the image quality is relatively large. Therefore, a transmissive combination region 123 having a larger area is formed by combining the adjacent light transmissive regions 122, and an amount of ambient light entering is increased, which is beneficial to offset influence of interference light and improves imaging effect. The light transmissive combination region 123 has various structural forms, which are exemplified below.

FIG. 15 shows a structure of a specific display panel 100. An image display region 121 of first pixel units 120 includes a rectangular shape, a light transmissive region 122 is disposed at an angular position of the image display region 121, and a light transmissive combination region 123 is formed by connecting at least two of the light transmissive regions having corresponding angular positions.

As shown in the figure, a repeating unit 190 is consisted of the plurality of first pixel units 120 in a group of four, four of the first pixel units 120 disposed within the repeating unit 190 are arranged in two columns, the first pixel units 120 are arranged in each column by two ways, that is, arranged in two rows crossing two columns (2×2), and each of the repeating units has a rectangular shape. Each of the first pixel units 120 has only one light transmissive region 122. In the repeating unit 190, four of the light transmissive regions 122 are connected to form the light transmissive combination region 123, and the light transmissive combination region 123 is formed at a central position of four first pixel units 120 and surrounded by the image display regions 121 of the four first pixel units 120.

The light transmissive combination region 123 is disposed in the middle region of each pixel. In each of the repeating units 190, the light transmissive region having impact on display of each of the corresponding first pixel units 120 is equal, while each light transmissive combination region 123 having impact on the each of the corresponding the repeating units 190 is also equal. Thus, influence on display image quality is less.

Display colors corresponding to the four first pixel units 120 correspond to red, blue, and green colors, respectively, and the green color is attenuated, quickly. Each repeating unit 190 adopts two first pixel units 120 corresponding to the green color, which can compensate for the green color.

Of course, in the repeating unit 190, the display colors corresponding to the four first pixel units 120 may be different, and the color mixing is better, so that the display effect is more delicate, but this is not necessary. It is even possible that the first pixel units 120 corresponding to the same color are arranged in a row or in a column, so that the first pixel units 120, which may have only two colors, are formed in the repeating unit 190. In addition, the repeating unit 190 may include more or even less of the first pixel units 120, such as two, three, or even six, or even more.

Only one light transmissive region 122 is disposed in each of the first pixel units 120, and each pixel unit has a rectangular shape, and the first pixel units 120 assume function of displaying image. Therefore, the light transmissive region 122 is disposed at an angular position of the first pixel units 120, and the corresponding display effect is less affected. Furthermore, corner of each of the first pixel units 120 is adjacent to corner of three other first pixel units 120, so that four corners of the light transmissive region 122 can be conveniently combined to form the light transmissive combination region 123. When an area of the light transmissive combination region 123 is constant, an area of light transmissive region 122 is evenly distributed to each of the first pixel units 120 and can be minimized. Therefore, influence of the corresponding display effect is minimized.

Only one light transmissive combination region 123 is formed in each of the repeating units 190, and a plurality of light transmissive combination regions 123 are respectively formed in the plurality of repeating units 190, and the plurality of the light transmissive combination regions 123 are arranged in a matrix arranged in rows and columns. Excessive light transmissive combination regions 123 affect the display effect. Therefore, each of the repeating units 190 has only one light transmissive combination region 123, and each of the repeating units 190 arranged in a matrix arranged in a row and row can better balance the contradiction between light transmission and display effect.

A shape of the light transmissive region 122 in each of the first pixel units 120 is a fan shape with a vertex angle of ninety degrees. Correspondingly, a shape of the light transmissive combination region 123 formed in each of the repeating units 190 is circular. Of course, the light transmissive combination region 123 can also be rectangular or other shapes.

FIG. 16 shows a structure of another specific display panel 100. An image display region 121 of each first pixel units 120 corresponds to two light transmissive regions 122, the two light transmissive regions 122 are respectively disposed at diagonal position of the image display region 121, and each of the light transmissive regions 122 is connected to one or three adjacent other light transmissive regions 122 to form a light transmissive combination region 123. Referring to the description of the above embodiment, four light transmissive regions 122 are combined to form the light transmissive combination region 123 in an intermediate region of an auxiliary display region 170. An edge part of the auxiliary display region 170 is taken over by a primary display region 160. In order to prevent impact on imaging quality of the primary display region 160, it is only necessary to combine with the adjacent light transmissive regions 122. More specifically, since there is only one image display region 121 at the four angular positions of the auxiliary display region 170, it is not necessary to combine with other light transmissive regions 122.

As seen from the drawing, the light transmissive combination regions 123 disposed in the middle of the auxiliary display region 170 are arranged in a straight line along scanning line direction of the display panel 100, and the light transmissive combination regions 123 are staggered in data line direction of the display panel 100. Due to staggered arrangement of the light transmissive combination regions 123, there may be more light transmissive combination regions 123, in the case an area of the auxiliary display region 170 is constant. Therefore, more ambient light can be collected, which further improves imaging configurations.

FIG. 17 shows a structure of another specific display panel 100. An image display region 121 of first pixel units 120 includes a rectangular shape. The difference from the above embodiment is that a light transmissive region 122 is disposed at a side position of the image display region 121, and a light transmissive combination region 123 is formed by connecting two of the transmissive regions 122 having corresponding side positions.

A repeating unit 190 is consisted of the plurality of first pixel units 120 in a group of four, four of the first pixel units 120 disposed within the repeating unit 190 are arranged in two columns, the first pixel units 120 are arranged in each column by two ways, that is, arranged in two rows crossing two columns (2×2), and each of the repeating units has a rectangular shape. Each of the first pixel units 120 has only one light transmissive region 122, which is combined with the light transmissive region 122 of the first pixel units 120 disposed in the same row to form the light transmissive combination region 123. Therefore, each of the repeating units 190 can have two light transmissive combination regions 123. On the one hand, when the number of light transmissive combination regions 123 is increased, it is beneficial for increasing the amount of light transmission. On the other hand, it is also possible to reduce influence of interference light of an image display region in the same repeating unit 190 on ambient light, thereby improving imaging quality.

Figure 18:
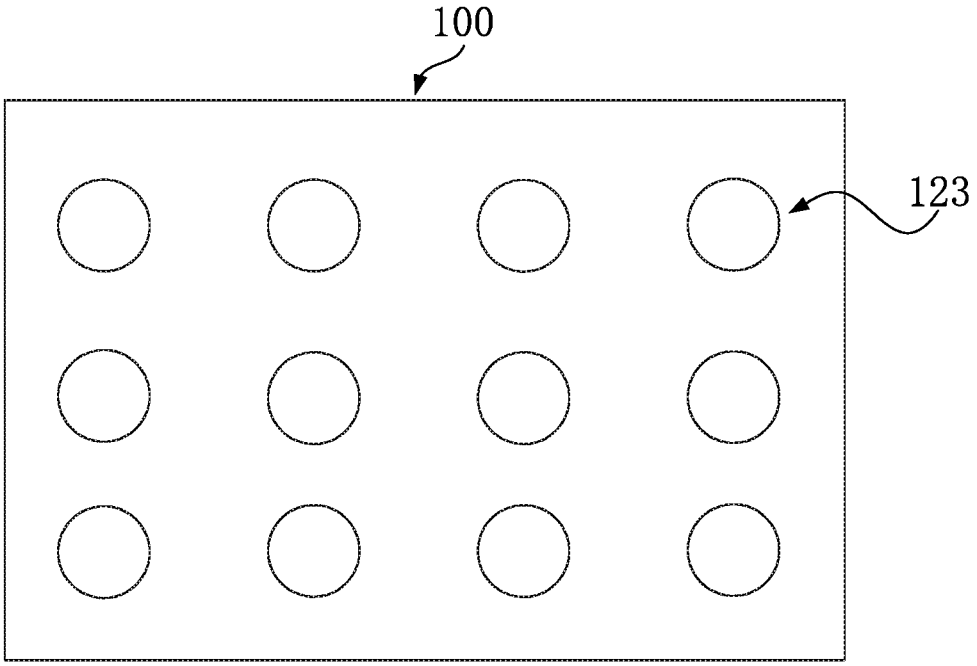
FIG. 18 is a schematic view of a distribution of a light transmissive combination region in a display panel according to one embodiment of the present invention.

FIG. 18 is a simplified schematic plan view of the display panel. The light transmissive combination regions 123 are arranged in a straight line in a longitudinal direction and a transverse direction, and the adjacent two light transmissive combination regions 123 are equally spaced, and all of the light transmissive combination regions 123 are presented as a mesh shape. Meanwhile, the shape, size, number, and relative position of the combined light-transmitting region 123 can be arranged according to specific requirements of the amount of light transmission, and then the relevant circuit optimization is considered to obtain a better imaging effect.

Figure 19:
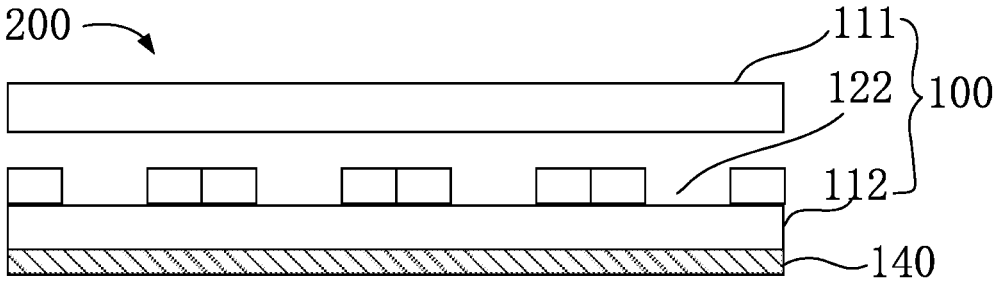
FIG. 19 is a schematic view of a display device according to one embodiment of the present invention.

FIG. 19 shows a display device 200 adopting the above display panel. The display device 200 further includes a photosensitive element 140 formed on outside of the display panel 100 and away from a light emitting surface of the display panel 100. The photosensitive element 140 collects incident light emitted from outside the display panel 100 through the plurality of light transmissive regions 122 of the display panel 100.

This is an external type of under-screen camera solution. The display panel 100 only needs to form the light transmissive regions 122, and the process is relatively simple and lower cost. The photosensitive element 140 is directly attached to the outside of the display panel 100 to facilitate production. Specifically, the display panel 100 includes two substrates, and inner sides of the two substrates are oppositely disposed, and various display devices of the display panel 100 are disposed therein. A first substrate 111 corresponds to the light emitting surface, and if it is a liquid crystal display panel, a second substrate 112 corresponds to the light incident surface. If it is an OLED display panel, the second substrate 112 is a base, which can be transparent or opaque. The photosensitive element is attached to the outside of the second substrate 112.

Figure 20:
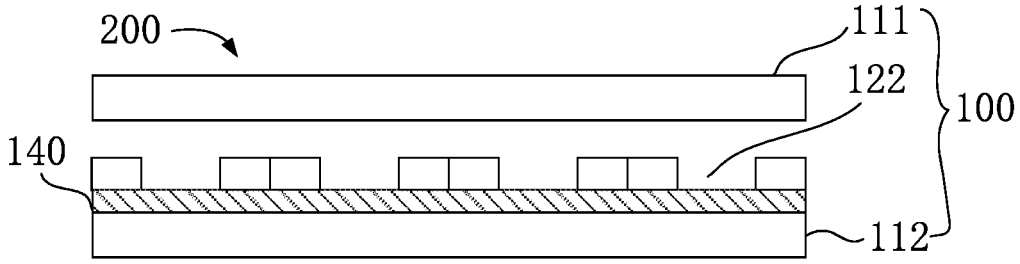
FIG. 20 is a schematic view of a display device according to another embodiment of the present invention.

FIG. 20 shows a display device 200 adopting the above display panel. The display panel further includes the photosensitive element 140 disposed inside the display panel 100, and the photosensitive element 140 collects incident light emitted from outside the display panel 100 through a plurality of the light transmissive regions 122 of the display panel 100.

This is an internal type of under-screen camera solution, and the photosensitive element 140 is disposed inside the display panel, that is, the photosensitive element corresponds to the inside of the second substrate 112 of the display panel. Of course, if the pixel unit corresponding to the light transmissive regions 122 is disposed on the first substrate 111, the photosensitive element 140 is disposed on the inside of the first substrate 111.

The photosensitive element 140 is formed synchronously in the manufacturing process of the display panel, and the photosensitive element 140 can be individually disposed in the display panel. Correspondingly, the first pixel unit is also individually disposed to form a plurality of auxiliary display regions to increase lighting area and enhance imaging quality. Since the first pixel unit is individually disposed, the photosensitive element 140 has a plurality of lighting positions. Lighting of different positions of the same subject is similar to the technical solution of multi-camera imaging, and the post-processing of software can also improve imaging quality.

The technical solution of the present invention can be widely applied to various display panels, such as a twisted nematic (TN) type display panel, that is, a twisted nematic panel; an in-plane switching (IPS) type display panel, that is, a plane conversion display panel; and a multi-domain vertical alignment (VA) type display panel, that is, a multi-domain vertical alignment technology. Of course, the display panel can also be other types of display panels, such as an organic light emitting diode (OLED) display panel.

The present application has been further described in detail in the above preferred embodiments, but the preferred embodiments are not intended to limit the scope of the invention, and a person skilled in the art may make various modifications without departing from the spirit and scope of the application. The scope of the present application is determined by the claims.

What is claimed is:

1. A display panel, comprising:

a plurality of first pixel units;

a first driving circuit;

a second pixel unit; and a second driving circuit;

wherein the first pixel units comprise:

an image display region driven by the first driving circuit to provide a corresponding brightness; and a light transmissive region, wherein an opening is formed at an edge of the image display region, the light transmissive region is formed within the opening, and an incident light emitted from an outer side of the display panel passes through the light transmissive region;

wherein a light transmissive combination region is formed by connecting at least two of the light transmissive regions of the first pixel units, and a periphery of the light transmissive combination region is surrounded by the image display region;

wherein the image display region comprises a rectangular shape, the light transmissive region is disposed at an angular position of the image display region, and the light transmissive combination region is formed by connecting at least two of the light transmissive regions having corresponding angular positions;

wherein a repeating unit is consisted of the plurality of first pixel units of the display panel in a group of four, four of the first pixel units disposed within the repeating unit are arranged in two columns, the first pixel units are arranged in each column by two ways, and the light transmissive combination region is formed at a central position of the repeating unit and surrounded by four image display regions;

wherein the image display region corresponds to two light transmissive regions, and the two light transmissive regions are respectively disposed at diagonal position of the image display region, and each of the light transmissive regions is connected to one or three adjacent other light transmissive regions to form the light transmissive combination region;

wherein the image display region comprises a rectangular shape, the light transmissive region is disposed at a side position of the image display region, the repeating unit is consisted of the plurality of first pixel units in a group of four, four of the first pixel units disposed within the repeating unit are arranged in two columns, the first pixel units are arranged in each column by two ways, the image display region comprises only one light transmissive region, and two light transmissive regions disposed in a same column corresponding to the image display region are combined to form the light transmissive combination region;

wherein the second driving circuit drives a plurality of the second pixel units to provide a corresponding brightness, and the light transmissive region is only formed within the first pixel units; and wherein number of active switches of the first driving circuit driving the first pixel units is less than number of active switches of the second driving circuit driving the second pixel units.

2. A display panel, comprising:

a plurality of first pixel units; and a first driving circuit;

wherein the first pixel units comprise:

an image display region driven by the first driving circuit to provide a corresponding brightness; and a light transmissive region, wherein an opening is formed at an edge of the image display region, the light transmissive region is formed within the opening, and an incident light emitted from an outer side of the display panel passes through the light transmissive region;

wherein a light transmissive combination region is formed by connecting at least two of the light transmissive regions of the first pixel units, and a periphery of the light transmissive combination region is surrounded by the image display region;

wherein the image display region comprises a rectangular shape, the light transmissive region is disposed at an angular position of the image display region, and the light transmissive combination region is formed by connecting at least two of the light transmissive regions having corresponding angular positions.

3. The display panel according to claim 2, wherein a repeating unit is consisted of the plurality of first pixel units of the display panel in a group of four, four of the first pixel units disposed within the repeating unit are arranged in two columns, the first pixel units are arranged in each column by two ways, and the light transmissive combination region is formed at a central position of the repeating unit and surrounded by four image display regions.

4. The display panel according to claim 2, wherein the image display region of each corresponds to two light transmissive regions, and the two light transmissive regions are respectively disposed at diagonal position of the image display region, and each of the light transmissive regions is connected to one or three adjacent other light transmissive regions to form the light transmissive combination region.

5. The display panel according to claim 2, wherein, the light transmissive region is disposed at a side position of the image display region, repeating unit is consisted of the plurality of first pixel units in a group of four, four of the first pixel units disposed within the repeating unit are arranged in two columns, the first pixel units are arranged in each column by two ways, the image display region comprises only one light transmissive region, and two light transmissive regions disposed in a same column corresponding to the image display region are combined to form the light transmissive combination region.

6. The display panel according to claim 2, further comprising a second pixel unit and a second driving circuit, wherein the second driving circuit drives a plurality of the second pixel units to provide a corresponding brightness, and the light transmissive region is only formed within the first pixel units.

7. The display panel according to claim 6, wherein number of active switches of the first driving circuit driving the first pixel units is less than number of active switches of the second driving circuit driving the second pixel units.

8. A display device, comprising:

the display panel of claim 2; and a photosensitive element disposed inside the display panel or outside the display panel, away from a light emitting surface of the display panel, wherein the photosensitive element collects incident light emitted from outside the display panel through a plurality of the light transmissive regions of the display panel.

9. The display device according to claim 8, wherein a repeating unit is consisted of the plurality of first pixel units of the display panel in a group of four, four of the first pixel units disposed within the repeating unit are arranged in two columns, the first pixel units are arranged in each column by two ways, and the light transmissive combination region is formed at a central position of the repeating unit and surrounded by four image display regions.

10. The display device according to claim 8, wherein the image display region corresponds to two light transmissive regions, and the two light transmissive regions are respectively disposed at diagonal position of the image display region, and each of the light transmissive regions is connected to one or three adjacent other light transmissive regions to form the light transmissive combination region.

11. The display device according to claim 8, wherein the image display region comprises the rectangular shape, the light transmissive region is disposed at a side position of the image display region, a repeating unit is consisted of the plurality of first pixel units in a group of four, four of the first pixel units disposed within the repeating unit are arranged in two columns, the first pixel units are arranged in each column by two ways, the image display region comprises only one light transmissive region, and two light transmissive regions disposed in a same column corresponding to the image display region are combined to form the light transmissive combination region.

12. The display device according to claim 8, wherein the display panel further comprises a second pixel unit and a second driving circuit, the second driving circuit drives a plurality of the second pixel units to provide a corresponding brightness, and the light transmissive region is only formed within the first pixel units.

13. The display device according to claim 12, wherein number of active switches of the first driving circuit driving the first pixel units is less than number of active switches of the second driving circuit driving the second pixel units.

* * * * *